US006237870B1

(12) United States Patent
Kawamura

(10) Patent No.: US 6,237,870 B1
(45) Date of Patent: May 29, 2001

(54) DEVICE FOR REMOVING PACKAGING MATERIAL FROM A WEB ROLL

(75) Inventor: Masanori Kawamura, Nishikasugai-gun (JP)

(73) Assignee: Kabushiki Kaisha Isowa Hooperswift (JP)

( * ) Notice: Subject to any disclaimer, the term of this patent is extended or adjusted under 35 U.S.C. 154(b) by 0 days.

(21) Appl. No.: 09/316,721

(22) Filed: May 21, 1999

(30) Foreign Application Priority Data

May 21, 1998 (JP) ..... 10-140252

(51) Int. Cl.[7] ..... B65H 16/00; B65H 35/00

(52) U.S. Cl. ..... 242/533; 242/535.4; 242/562; 242/527

(58) Field of Search ..... 242/535.4, 533, 242/562, 562.1, 535.1, 550, 527

(56) References Cited

U.S. PATENT DOCUMENTS 2,638,725 * 5/1953 Hurter et al. ..... 242/533
4,550,881 * 11/1985 Boardman ..... 242/533
4,821,971 * 4/1989 Watanabe et al. ..... 242/562
5,080,297 * 1/1992 Blaimschein ..... 242/535.4
5,421,535 * 6/1995 Hemmert et al. ..... 242/535.4

FOREIGN PATENT DOCUMENTS 196 07 541C 7/1997 (DE) .
55-31774 * 3/1980 (JP) ..... 242/550
63-317431A 4/1989 (JP) .

* cited by examiner

*Primary Examiner*—Katherine A. Matecki
(74) *Attorney, Agent, or Firm*—Morrison Law Firm

(57) ABSTRACT

A cutting device and a wedge shaped separating member are used to cut a packaging material wrapped around an outer perimeter surface of a web roll. The separating member is inserted under the packaging material. A cutting blade is fixed above the separating member to provide for the cutting of the packaging material when the cutting device and separating member are moved along a lateral axis of the web roll. The cut packaging material is completely separated by a second cutting device. The separated packaging material is then rolled and compacted. The result is an automated device which saves time and labor when removing packaging material from a web roll. Furthermore, the removed packaging material is compact, providing for reduced storage and disposal space.

4 Claims, 9 Drawing Sheets

DEVICE FOR REMOVING PACKAGING MATERIAL FROM A WEB ROLL

BACKGROUND OF THE INVENTION

The present invention relates to a device for removing packaging material from a web roll. More specifically, the present invention relates to a device for automatically removing packaging material covering the outer perimeter of a web packaging roll.

Rolls in which long sheets of single-piece webs, such as paper and metal foil, or composite sheets, such as laminated film, are rolled around a hollow core. These rolls are used in a variety of ways in a variety of different fields. For example, in rotary offset presses and rotary letter presses, the web to be printed is wrapped as a roll (hereinafter referred to as a web roll) and mounted in a web feeding device, feeding the web off the web roll.

A packaging material is rolled around an outer perimeter surface to cover the web roll. This packaging material prevents the web roll from becoming damaged or dirty when it is transported from a paper plant to a printing plant. When the web roll arrives at the printing plant, the packaging material must be removed before the web roll is used. The removal of the packaging material from the web roll is performed manually by a worker. The manual removal of the packaging material from the web roll takes time and reduces efficiency. The worker must also perform the complicated and tedious task of rolling up the packaging material removed from the web roll and disposing of it.

OBJECTS AND SUMMARY OF THE INVENTION

An object of the present invention is to provide a device to remove packaging material from a web roll which overcomes the foregoing problems.

A further object of the present invention is to provide a device to remove packaging material from a web roll which automatically removes the packaging material covering the outer perimeter surface of a web roll.

A further object of the present invention is to provide a device to remove packaging material from a web roll which reduces the time and labor involved to remove the packaging material.

Briefly stated, the present invention provides a cutting device and a wedge shaped separating member useful for cutting a packaging material wrapped around an outer perimeter surface of a web roll. The separating member is inserted under the packaging material. A cutting blade is fixed above the separating member to provide for the cutting of the packaging material when the cutting device and separating member are moved along a lateral axis of the web roll. The cut packaging material is completely separated by a second cutting device. The separated packaging material is then rolled and compacted. The result is an automated device which saves time and labor when removing packaging material from a web roll. Furthermore, the removed packaging material is compact, providing for reduced storage and disposal space.

According to an embodiment of the present invention, there is provided a device for removing a packaging material covering an outer perimeter surface of a web roll comprising a cutting device disposed to move along a lateral axis of the web roll, cutting at least the packaging material using a packaging material cutting blade, a separating member moving in tandem with the cutting device, inserting at a point under the packaging material from a lateral end, the separating member separating at least the packaging material from the web roll, and rolling means for rolling up the packaging material cut by the cutting device to produce a loose roll of packaging material.

According to a further embodiment of the present invention, there is provided an arcuate roll-up device comprising means for feeding at least a leading edge of a web to the roll-up device, and means for directing the leading edge along a reentrant path, whereby a roll is formed.

According to still a further embodiment of the present invention, there is provided a device for removing a packaging material covering an outer perimeter surface of a web roll comprising means for cutting at least the packaging material parallel to an axis of the web roll, means for directing a leading edge of at least the packaging material from the web roll into a feeding means, the feeding means including means for directing separated packaging material into a rolling means, and the rolling means including means for rolling the separated packaging material from the feeding means into a loose roll.

The above, and other objects, features, and advantages of the present invention will become apparent from the following description read in conjunction with the accompanying drawings, in which like reference numerals designate the same elements.

DETAILED DESCRIPTION OF THE INVENTION

Figure 1:
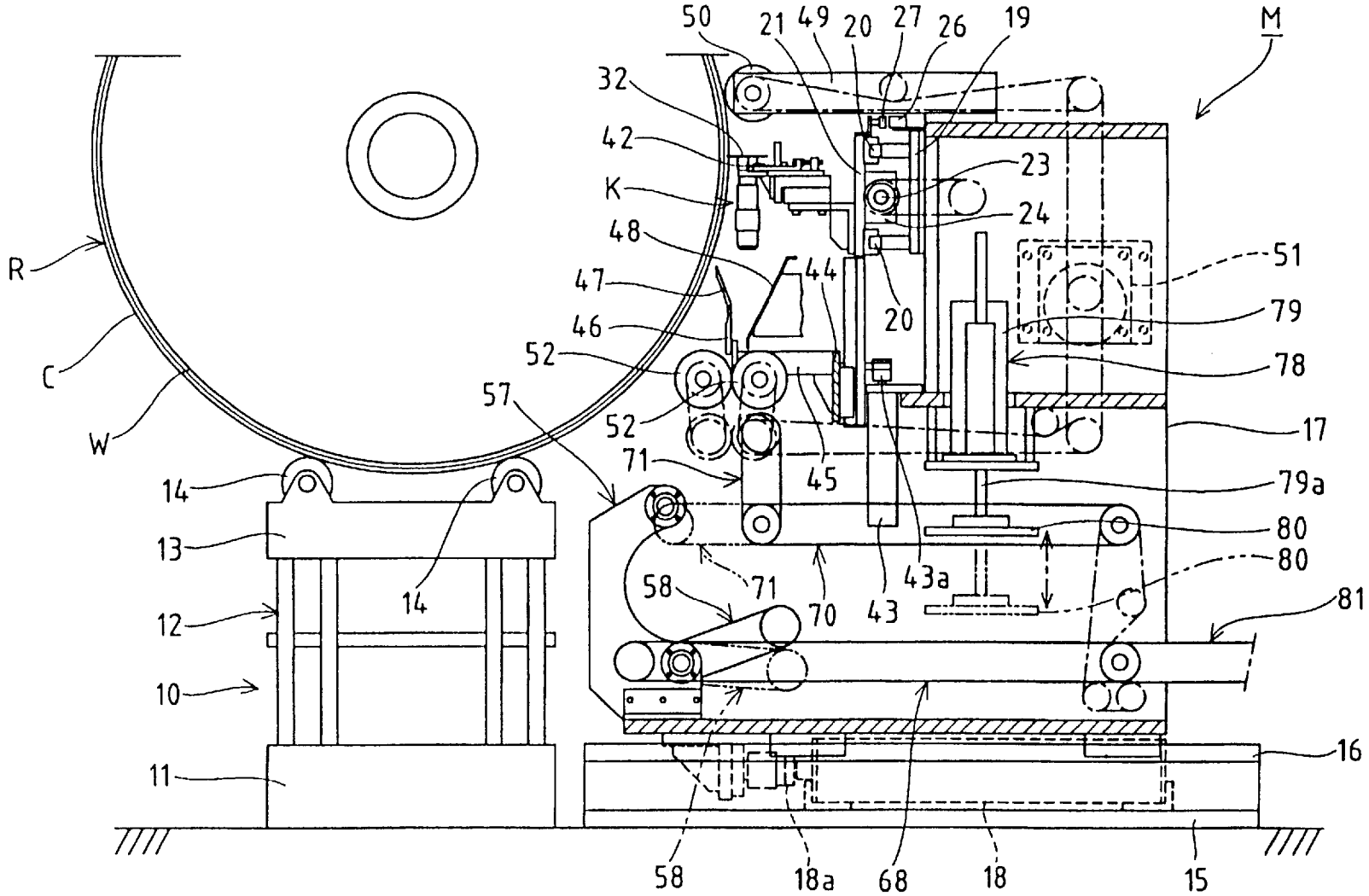
FIG. 1 is a cross-sectional side view of the packaging material removal device according to the present invention.

Referring to FIG. 1, a device M, for removing packaging material from a web roll, has a supporting device 10 rotatably supporting a web roll R. An outer perimeter surface of web roll R is covered by a packaging material C. A movable table 13, disposed on a base 11, is raised and lowed by a lift device 12. Lift device 12 uses any of the well known lifting means, such as a parallel linkage mechanism. A pair of rollers 14 is rotatably disposed above front and rear portions of movable table 13. Web roll R is rotatably mounted between rollers 14. Web roll R is raised and lowered to align the center of web roll R roughly at the same level as the position of a cutting device K.

Base 15, located adjacent to support device 10, has a pair of guide rails 16 (only one is shown in the figure). Guide rails 16 extend along a longitudinal axis of support device 10. Guide rails 16 are separated along a lateral axis of web roll R. A main unit 17 is slidably mounted on guide rails 16. Main unit 17 connects to a piston rod 18*a* of a hydraulic cylinder 18. Hydraulic cylinder 18 attaches to base 15. The action of cylinder 18 causes main unit 17 to radially approach and move away from web roll R supported by supporting device 10.

Cutting device K, on the side of main unit 17, points toward the web roll R to laterally cut packaging material C.

Figure 2:
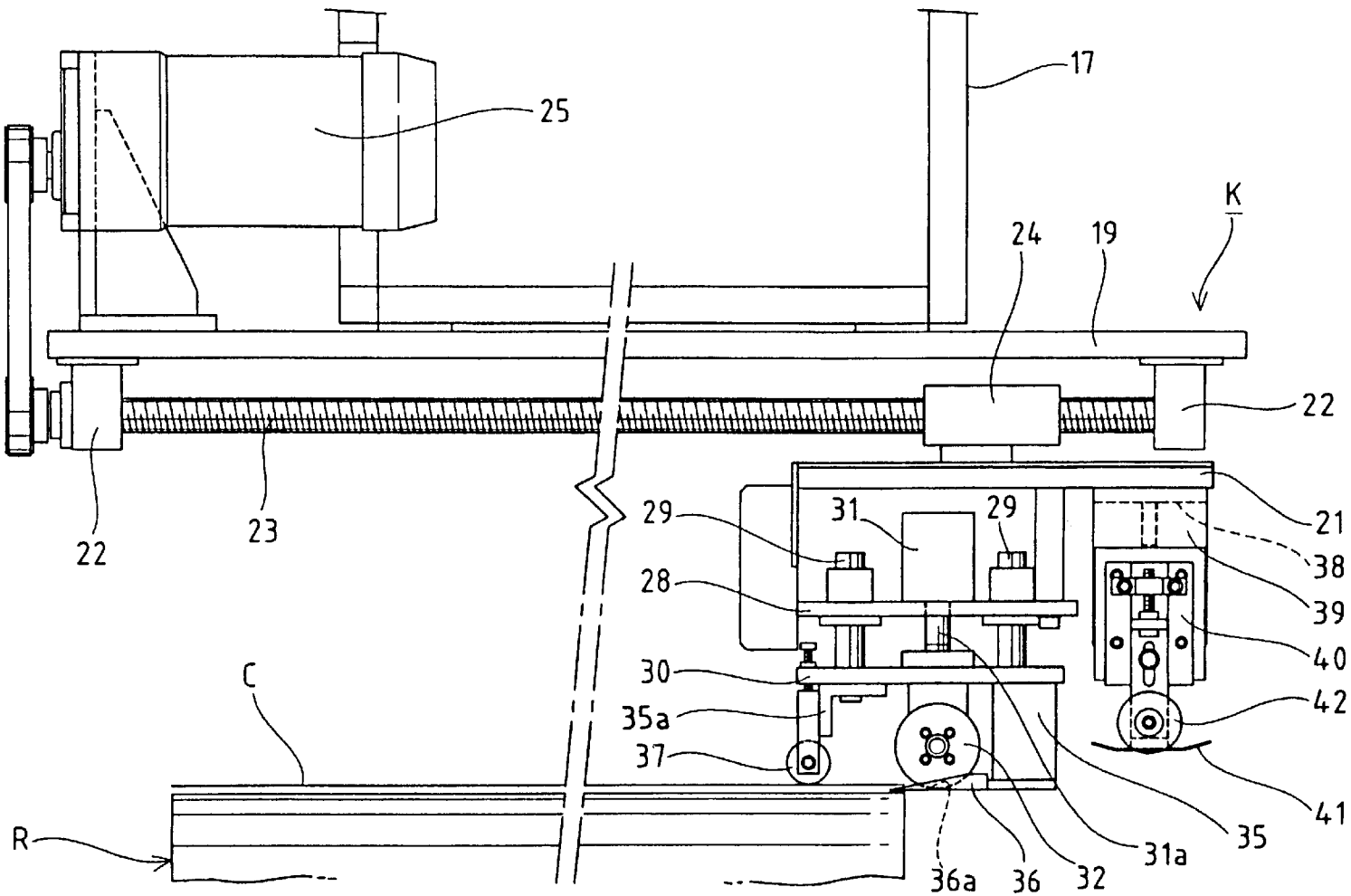
FIG. 2 is a plan drawing showing the cutting device of FIG. 1.
Figure 3:
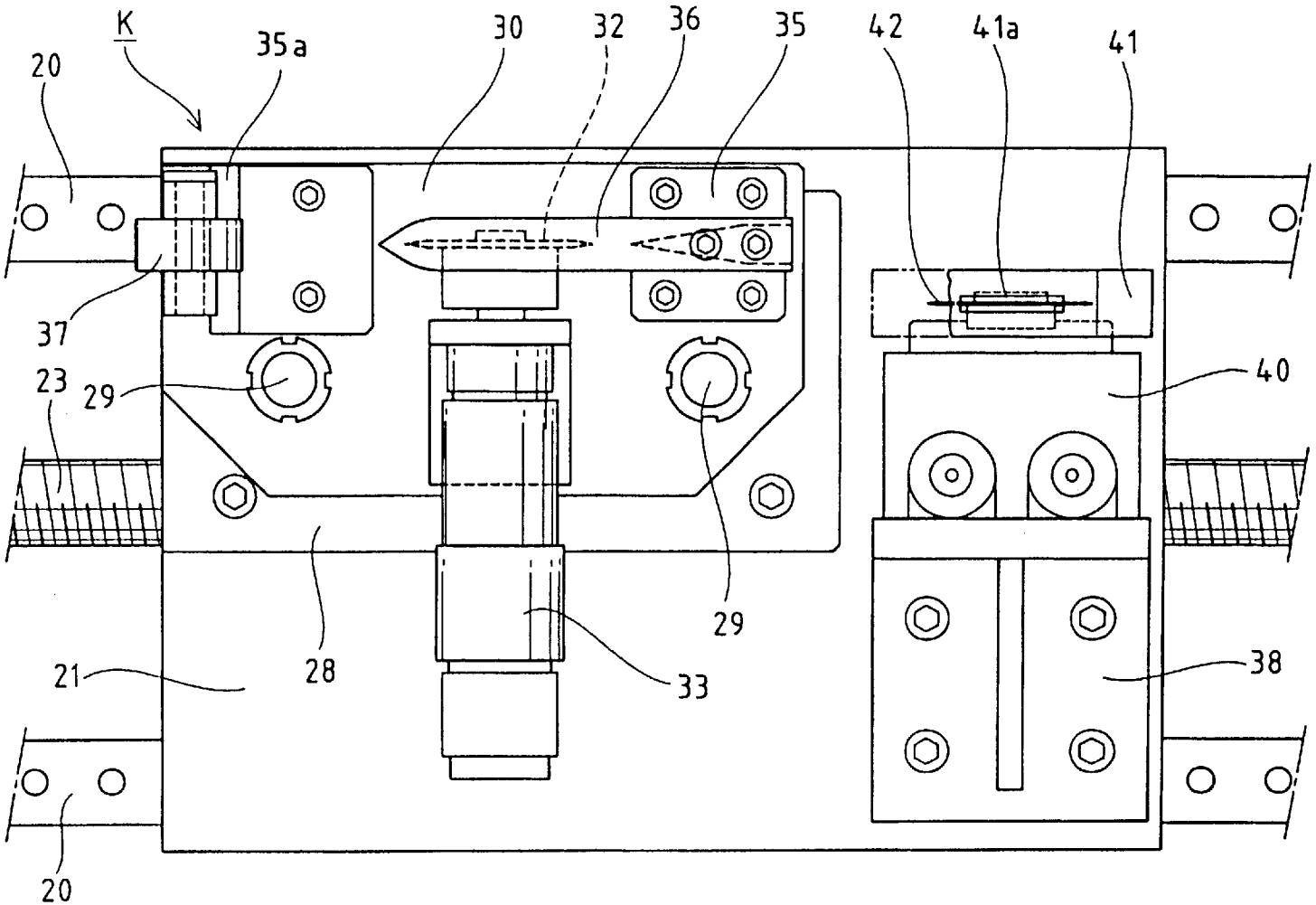
FIG. 3 is a schematic front view drawing showing the cutting device of FIG. 1.

Referring to FIGS. 2 and 3, an attachment plate 19, positioned at a top front surface of main unit 17, extends parallel to the lateral axis of web roll R. A pair of guide rails 20 run parallel to each other on a front vertical surface of attachment plate 19. Moving body 21 is slidably positioned on guide rails 20. A screw shaft 23 is rotatably interposed between a pair of opposing shaft bearings 22 located at lateral end regions of attachment plate 19. Screw shaft 23 screws into a nut member 24 fixed to movable body 21. Screw shaft 23 also connects to a displacement motor 25 disposed on attachment plate 19. Displacement motor 25 provides for the dual directional rotation of screw shaft 23. Thus, when displacement motor 25 rotates screw shaft 23, the engagement between screw shaft 23 and nut member 24 causes movable body 21 to move back and forth along guide rails 20.

Guide rails 20 and screw shaft 23 have lengths greater than the length of web roll R. Movable body 21 is movable from one lateral end of web roll R to the other end. A pair of position detection sensors 26 (only one is shown in FIG. 1) are separated from each other along a lateral axis of main unit 17. A dog 27, detectable by detection sensors 26, is located on movable body 21. Displacement motor 25 moves movable body 21 back and forth between position detection sensors 26. When movable body 21 is in a standby state, movable body 21 is positioned toward the right ends of guide rails 20. When movable body 21 moves left from this standby position, a first cutting blade 32 laterally cuts packaging material C.

A first fixing member 28 is located on a front surface of movable body 21. A pair of guide rods 29, separated along the lateral axis of fixing member 28, move in a direction perpendicular to movable body 21. A first holder 30 is located on the front ends of guide rods 29. A hydraulic cylinder 31, located on first fixing member 28, has a piston rod 31*a* which connects to first holder 30. Cylinder 31 displaces first holder 30 longitudinally. A disc-shaped first cutting blade (cutting blade for packaging) 32 is rotatably disposed on a front surface of first holder 30 with its rotation axis oriented parallel to first holder 30. First cutting blade 32 rotates by an air motor 33.

A separating member 36, located under first cutting blade 32, connects to first holder 30 using a bracket 35. Separating member 36 extends across a prescribed lateral distance under first cutting blade 32. Separating member 36 is formed in the shape of a wedge having a thick end extending behind first cutting blade 32. As moving body 21 moves left from the standby position, a thin end of separating member 36 passes between packaging material C and web W, thus separating packaging material C from web roll R. A groove 36*a* is formed on a rear surface of separating member 36 facing first cutting blade 32 so that separating member 36 does not obstruct first cutting blade 32. This structure allows packaging material C to be reliably cut by first cutting blade 32. This structure also helps guide the cut packaging material at the rear of separating member 36.

Packaging material C, covering web roll R, is wound relatively tightly around inner web W, making it difficult to insert separating member 36 between packaging material C and web W. In this embodiment of the present invention, separating member 36 may be inserted between two layers of web W, preferably two layers of web W near packaging material C. In other words, first cutting blade 32 cuts multiple sheets of web W in addition to packaging material C.

A positioning roller 37 is rotatably disposed in front of (to the left in FIG. 2) first cutting blade 32 on a bracket 35*b*. Hydraulic cylinder 31 applies a prescribed pressure to an outer perimeter surface of web roll R (an outer surface of packaging material C). Positioning roller 37 is adjustable to control the depth at which a tip of separating member 36 is inserted into web roll R. With positioning roller 37 in contact with an outer perimeter surface of web roll R, the tip of separating member 36 is reliably inserted either between packaging material C and a first layer of web W, or between two layers of web W.

A second fixing member 38, on a front surface of moving body 21 behind first fixing member 28, has a second holder 40 attached to second fixing member 38 with a hydraulic cylinder 39. Second holder 40 moves freely along an axis perpendicular to web roll R according to the action of cylinder 39. A front end of second holder 40 has a guide plate 41 extending in the direction of movement of moving body 21. A disc-shaped second blade (web cutting blade) 42, located behind guide plate 41, has an axis of rotation substantially the same as first cutting blade 32. Second cutting blade 42 projects forward by a prescribed amount through a slit 41*a* formed in guide plate 41. The cut packaging material is drawn off web roll R through a feed path (which will be described in more detail in the following paragraphs). When hydraulic cylinder 39 activates, second cutting blade 42 moves from a standby position to an active position proximal to web roll R. Moving body 21 moves from the left end to the right end (the standby position) to laterally cut web W that has been drawn out from web roll R into the feed path, thus cutting and separating packaging material C and web W.

A pair of laterally separated hydraulic guide cylinders 43 (only one is shown in FIG. 1) is vertically located in main unit 17 below cutting device K. A lifting member 44 is raised and lowered by piston rods 43*a* of guide cylinders 43. A pair of laterally separated support plates 45 projects forward from lifting member 44. A fixing plate 46, formed between front ends of support plates 45, has attached a first guide plate 47 which projects upward from fixing plate 46 by a prescribed amount. First guide plate 47 tilts within an appropriate range at an upper end of fixing plate 46. A free upper end of first guide plate 47 tilts forward of its own weight so that the free upper end of first guide plate 47 is proximal to web roll R (see FIG. 1). A second guide plate 48 tilts toward fixing plate 46. Packaging material C and web W cut by cutting device K are guided downward and pass through guide plates 47 and 48.

When second cutting blade 42 cuts web W, first guide plate 47 (FIG. 1) is raised to a position near a front surface of second cutting blade 42. First guide plate 47 supports the front side of web W providing for reliable cutting of web W. As first guide plate 47 rises, first guide plate 47 comes into contact with an outer perimeter surface of web roll R. First guide plate 47 then gradually tilts backward so that its raised end becomes substantially vertical.

Referring back to FIG. 1, at an upper portion of main unit 17, a pair of laterally separated support plates 49 (only one is shown in the figure) extends forward a prescribed distance. A first feeding roller 50 is rotatably disposed between extended ends of support plates 49. First feeding roller 50 connects to a feed motor 51 located in main unit 17. Feed motor 51 rotates feeding roller 50 in a prescribed direction. When packaging material C is being cut and unwrapped, a main unit hydraulic cylinder 18 moves main unit 17 forward (to the left in FIG. 1) up to a position where first feed roller 50 contacts web roll R supported by supporting device 10. Then, when first feed roller 50 is in contact with web roll R, roller 50 is rotated, rotating web roll R on the supporting device 10. A leading edge of cut packaging material C (with cut web W) is stripped from web roll R by first guide plate 47. Cut packaging material C and web W are fed between first guide plate 47 and second guide plate 48.

A pair of laterally extending front and rear second feed rollers 52 is rotatably positioned below first and second guide plates 47 and 48. Second feed rollers 52 are rotated in opposite directions by feed motor 51. A hydraulic cylinder (not shown in the figures), disposed in the main unit 17, moves a rear second feed roller 52 between a feed position, where it is in contact with a front second feed roller 52, and a standby position, where rear second feed roller 52 is away from front second feed roller 52. Packaging material C and web W guided by first and second guide plates 47 and 48 are guided downward between second feed rollers 52.

Figure 5:
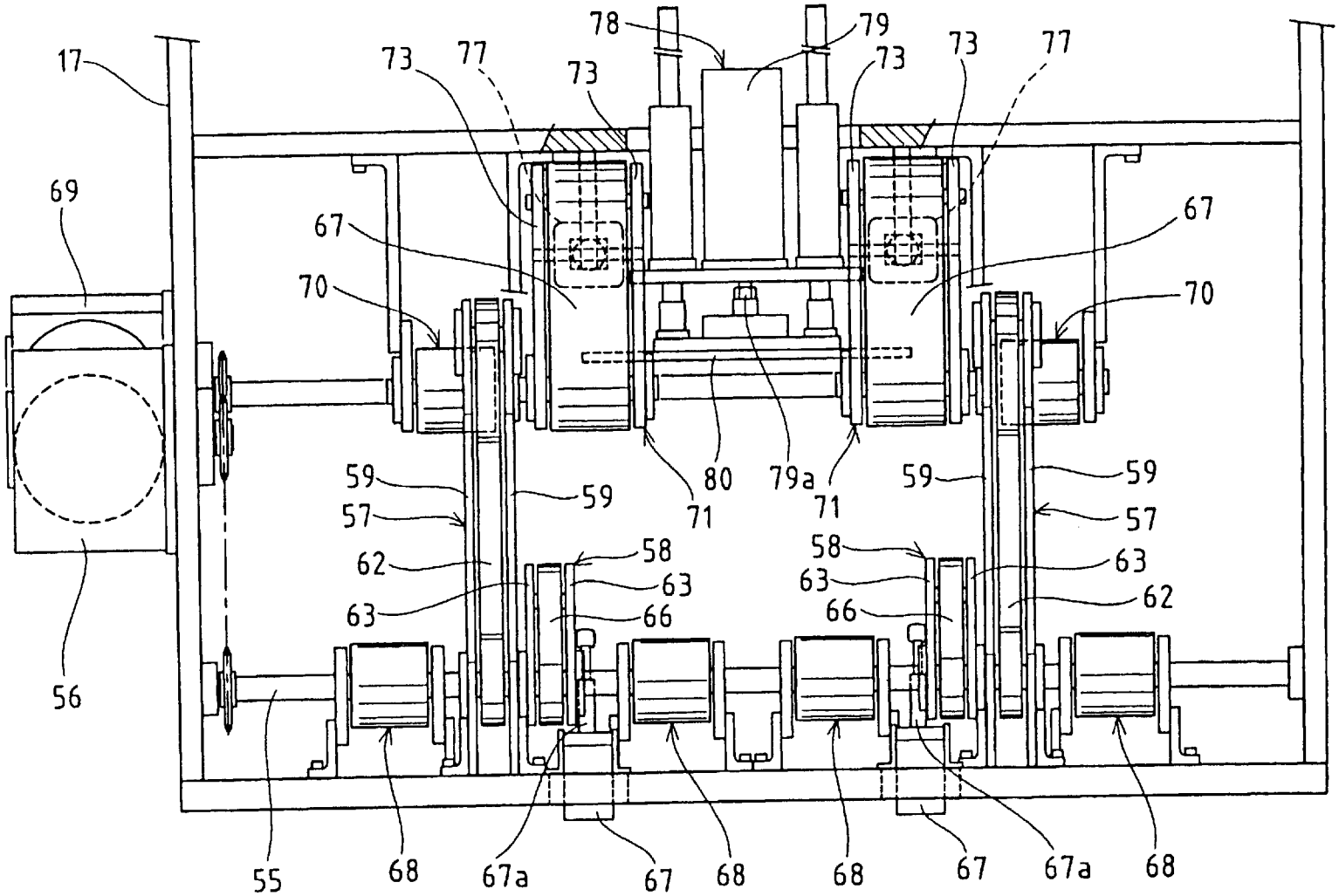
FIG. 5 is a schematic front view drawing showing roll-up means and transporting means according to an embodiment of the present invention.
Figure 6:
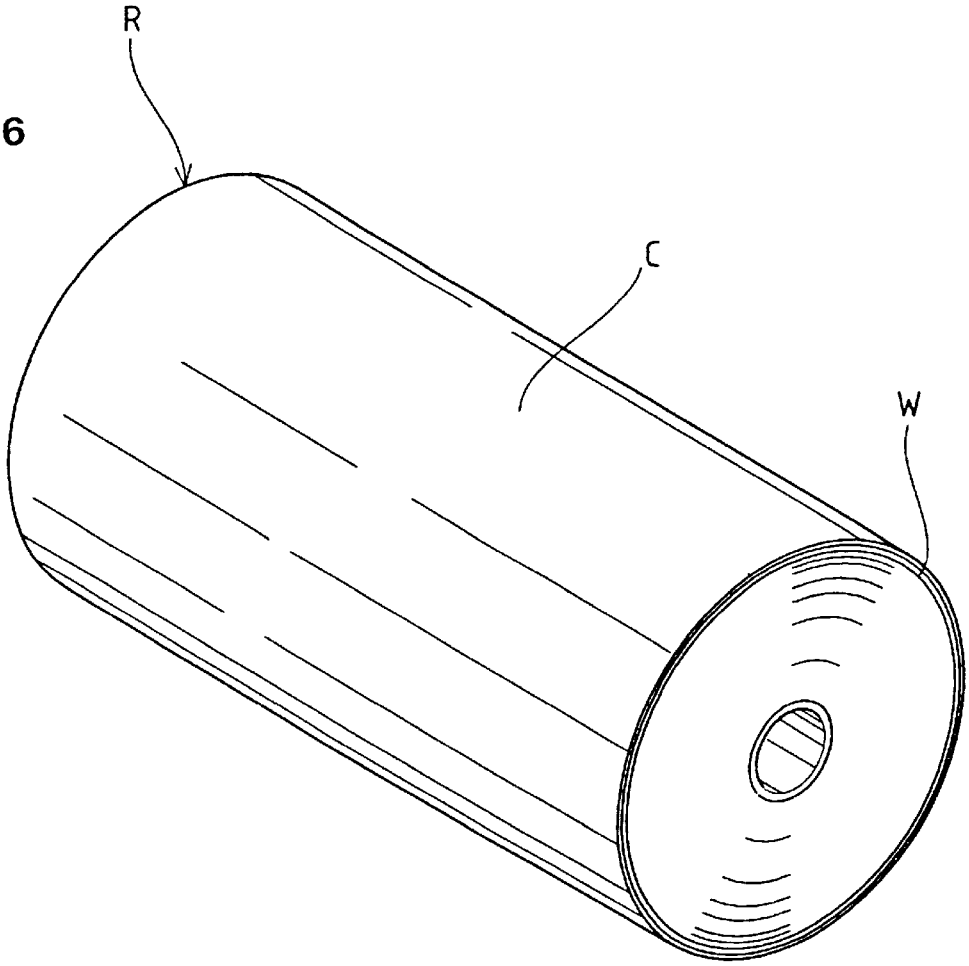
FIG. 6 is a perspective drawing showing a web roll whose outer perimeter surface is covered with a packaging material.

Referring to FIGS. 1 and 5, a laterally extended drive shaft 55 is rotatably supported in main unit 17 below second feed rollers 52. Drive shaft 55 is rotated in a prescribed direction by a roll-up motor 56. Multiple laterally separated first roll-up conveyors 57 and second roll-up conveyors 58 (two each in this embodiment of the invention), located below second feed rollers 52, serve as means for rolling up packaging material C and web W fed by rollers 52. Multiple roll-up conveyors 57 and 58 are driven in tandem by drive shaft 55.

Figure 4:
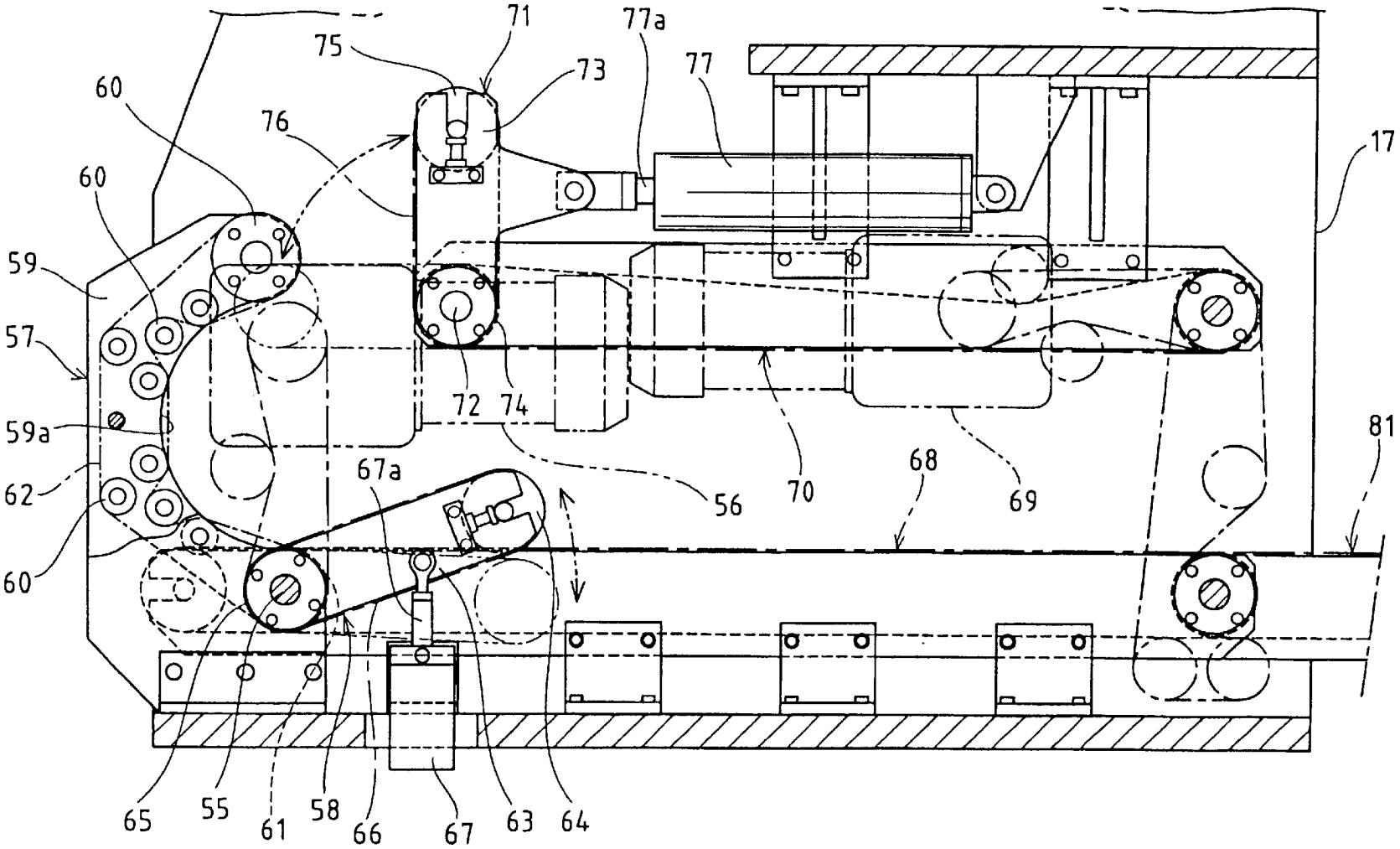
FIG. 4 is a schematic side view drawing showing roll-up means and transporting means according to an embodiment of the present invention.

Referring to FIGS. 4 and 5, first roll-up conveyor 57 has multiple first driven pulleys 60 rotatably disposed in an appropriate arrangement between a pair of laterally separated first frames 59. Drive shaft 55 is rotatably inserted through frames 59. A first drive pulley 61 rotates in tandem with drive shaft 55 extending between frames 59. An endless belt 62 extends between first drive pulley 61 and multiple first driven pulleys 60. A rear edge 59*a* of first frame 59 has an arcuate shape. Drive shaft 55 rotates first drive pulley 61 with a rear transport section of first endless belt 62 traveling upward roughly along arcuate rear edge 59*a*.

A second roll-up conveyor 58 disposed inward and adjacent to first roll-up conveyor 57 includes a pair of laterally separated second frames 63 extending rearward and rotatable with drive shaft 55. A second driven pulley 64 rotates between extended ends of frames 63. Second drive pulley 65 rotates integrally with drive shaft 55, extending between second frames 63. An endless belt 66 extends between second drive pulley 65 and second driven pulley 64. Drive shaft 55 rotates second drive pulley 65 with a transport section on an upper side of second endless belt 66 traveling from driven pulley 64 to drive pulley 65 from the rear to the front. Both the transport sections on the upper side of endless belt 66 and the transport section on the rear side of endless belt 62 travel in a clockwise direction. Thus, packaging material C and web W, fed from second feed rollers 52, contacts the transport section to be rolled up in a clockwise direction (see FIG. 8).

A piston rod 67*a* of a roll-up hydraulic cylinder 67 is rotatably supported by main unit 17. Piston rod 67*a* is pivotally connected to one of second frames 63 of second roll-up conveyor 58. The action of roll-up hydraulic cylinder 67 pivots second roll-up conveyor 58 about drive shaft 55 with the upper transport section positioned between an active position and a recessed position, which are respectively above and below an upper transport section of a first lower transport belt conveyor 68.

Multiple lower transport belt conveyors 68, adjacent to first and second conveyors 57 and 58, extend longitudinally over a prescribed length. In this embodiment of the present invention shown in FIG. 5, two lower transport belt conveyors 68 are disposed between a pair of second roll-up conveyors 58, while a single lower transport belt conveyor 68 is disposed outside each first roll-up conveyor 57. The four lower transport belt conveyors 68 connect to a transport motor 69. The upper transport section of lower transport belt conveyors 68 are conveyed from the front to the rear of main unit 17 with rolled-up packaging material $C_1$ (not shown) transported rearward.

Multiple (two in this embodiment) laterally separated upper transport belt conveyors 70 extend longitudinally over a prescribed length at a prescribed distance above the upper transport section of lower transport belt conveyors 68. Upper transport belt conveyors 70 connect to transport motor 69 and a lower transport section thereof conveys from the front to the rear of main unit 17 (from left to right in FIG. 4). The distance between upper and lower transport belt conveyors 68 and 70 is smaller than the height of rolled-up packaging material $C_1$ (not shown) rolled up by roll-up conveyors 57 and 58. Rolled-up packaging material $C_1$,interposed between belt conveyors 57 and 58 from above and below respectively, is reliably transported rearward. Upper transport belt conveyor 70 is positioned with its front end positioned rearward from the feed path of packaging material C, which is fed downward by second feed rolls 52. The positioning of upper transport belt conveyor 70 prevents the obstruction of the feeding of packaging material C.

When a front end of the upper transport belt conveyor 70 is positioned as described above, packaging material $C_1$, rolled up by roll-up conveyors 57 and 58, is transported rearward to upper transport belt conveyor 70 solely by lower transport belt conveyor 68. Since packaging material $C_1$ is light, transport of rolled-up packaging material $C_1$ is unreliable. Therefore, in this embodiment of the present invention, a feed conveyor 71 is positioned at the front of upper transport belt conveyor 70. Feed conveyor 71 is positioned between a recessed position, where feed conveyor 71 does not obstruct the feed path of packaging material C, and an active position, where feed conveyor 71 comes into contact with a top of rolled-up packaging material $C_1$ mounted on the upper transport section of lower transport belt conveyor 68. Rolled-up packaging material $C_1$ is interposed between feed conveyor 71 and lower transport belt conveyor 68 to provide reliably conveyance.

Feed conveyor 71 includes a laterally separated pair of frames 73 positioned inward from upper transport belt conveyor 70. Frames 73 are rotatably connected to front rotating shaft 72 of conveyor 70. When recessed, frames 73 are upright with their extended ends oriented as indicated by solid lines in FIG. 4. In an active position, frames 73 are horizontal. A drive pulley 74, on rotation shaft 72 interposed between frames 73, rotates in tandem with rotation shaft 72. A drive pulley 75 is rotatably positioned between extended ends of frames 73. An endless belt 76 extends between drive pulley 74 and driven pulley 75. When upper transport belt conveyor 70 is active, rotating shaft 72 rotates. When in the active position, the transport section in the lower portion of endless belt 76 circulates at feed conveyor 71 from the front to the rear (the same direction as upper transport belt conveyor 70).

One frame 73 of feed conveyor 71 connects to a piston rod 77*a* of a feed hydraulic cylinder 77, which is disposed above upper transport belt conveyor 70. Feed hydraulic cylinder 77 is pivotally connected to main unit 17, causing feed conveyor 71 to pivot about rotating shaft 72, moving the lower transport section of endless belt 76 between an upright recessed position and a horizontal active position, as described above. When feed conveyor 71 is active, rolled-up packaging material $C_1$, rolled up by first and second roll-up conveyors 57 and 58, is transported rearward interposed between feed conveyor 71 and lower transport belt conveyor 68.

A press 78, positioned between a pair of upper transport belt conveyors 70, flattens rolled-up packaging material $C_1$. Press 78 includes a hydraulic press cylinder 79 disposed upright in main unit 17, and a press plate 80, connected to a piston rod 79*a* below cylinder 79. A reciprocating action from hydraulic press cylinder 79 flattens rolled-up packaging material $C_1$ mounted on lower transport belt conveyor 68 (see FIG. 12). When in the standby position, press plate 80 is positioned above the lower transport section of upper transport belt conveyor 70. Press 78 is set up so that rolled-up packaging material $C_1$ is compressed by press plate 80 any number of times.

Rearward-extending exit belt conveyors 81 are disposed inward from the outermost lower transport belt conveyors 68. Flattened packaging material $C_2$, which has been flattened by press 78, is fed out of main device 17 by exit belt conveyors 81.

The following is a description of how the device for removing packaging material according to this embodiment operates. First, web roll R covered on its outer perimeter surface with packaging material C is mounted on movable table 13 of support device 10.

Referring to FIG. 1, table 13 is raised using lift device 12 until a center axis of web roll R is roughly aligned at the same height as cutting device K. Main unit hydraulic cylinder 18 is activated to make main unit 17 approach web roll R. Main unit 17 stops when first feed roller 50 contacts an outer perimeter surface of web roll R. Moving body 21 of cutting device K is positioned at a standby position at the right end of main unit 17. A tip of separating member 36 extends into an end of web roll R.

Figure 7:
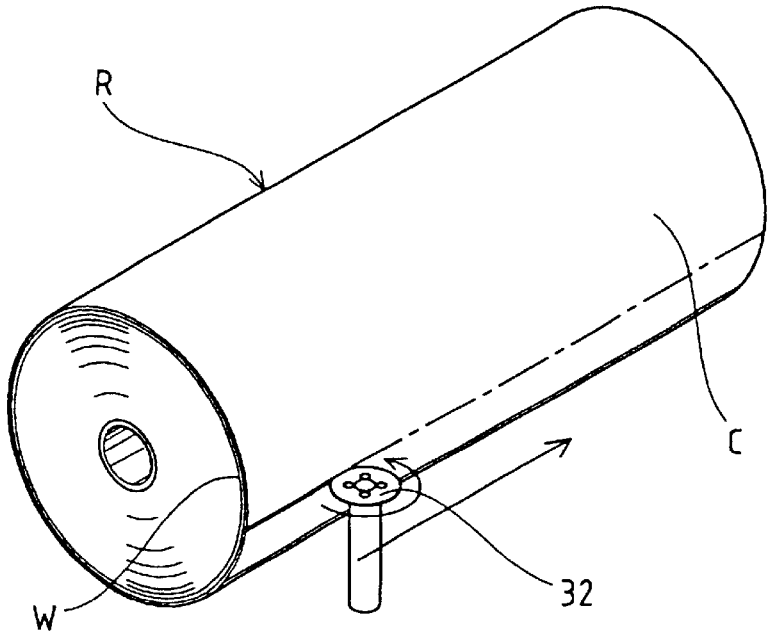
FIG. 7 is a drawing showing the first cutting blade cutting the packaging material laterally.

First holder hydraulic cylinder 31 of cutting device K activates to move first holder 30 forward, causing positioning roller 37 to contact and apply a prescribed pressure to an outer perimeter surface of web roll R. Displacement motor 25 then activates to displace moving body 21 along the width of web roll R (leftward from the standby position). The tip of wedge-shaped separating member 36 is inserted between two layers of web W, inward from packaging material C. Packaging material C and multiple sheets of web W separate from the main roll. The separated packaging material C and multiple sheets of web W are guided toward the rear of separating member 36. First cutting blade 32 rotates by air motor 33. As moving body 21 is displaced, packaging material C and multiple sheets of the web W, guided to the rear of separating member 36, are cut laterally by first cutting blade 32, as shown in FIG. 7.

Once first cutting blade 32 finishes cutting web W and packaging material C, dog 27, disposed in moving body 21, is detected by position detection sensor 26. Moving body 21 stops. First feed roll 50 rotates in an appropriate direction (the direction to make web roll R rotate clockwise in FIG. 8). As a result, web roll R supported on supporting device 10 rotates clockwise. The downward pointing cut end of packaging material C and web W is stripped from web roll R and fed between a pair of guide plates 47 and 48 positioned below. At an appropriate timing, hydraulic cylinder for rear second feed roller 52 activates, and rear second feed roller 52 comes into a feed position toward front second feed roller 52. The position of feed rollers 52 allows packaging material C and web W to be interposed between rollers 52. When first feed roller 50 rotates, second feed rollers 52 also rotate so that packaging material C and web W guided between rotating second feed rollers 52 feed further downward.

Figure 8:
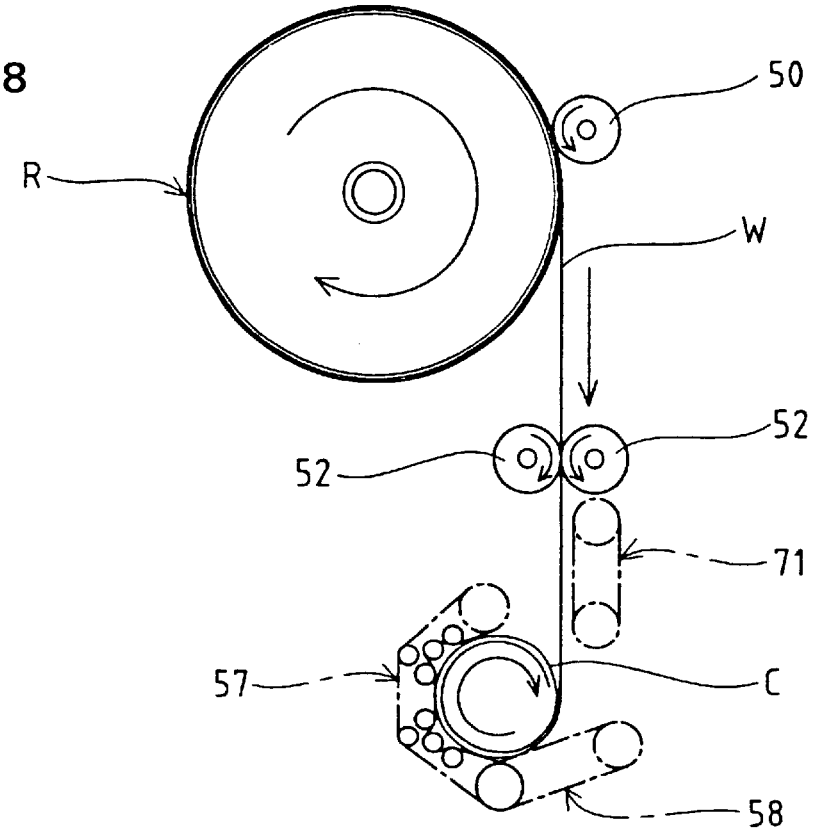
FIG. 8 is a drawing showing the roll-up means rolling up the packaging material.

The cut end of packaging material C and web W fed from second feed rollers 52 contacts second endless belt 66 of second roll-up conveyor 58, which is in the active position. As belt 66 is conveyed, the cut end is transported toward first roll-up conveyor 57. Then, as belt 62 is conveyed, the cut end of packaging material C and web W, contacting first endless belt 62 of first roll-up conveyor 57, is transported upward along arcuate rear edges 59*a* of first frames 59. In other words, packaging material C and web W are fed to roll-up conveyors 57 and 58, rotating clockwise, as shown in FIG. 8. This rotation results in the material being rolled up. In this embodiment of the present invention, packaging material C and the multiple sheets of web W are stacked against each other as they are rolled up.

An appropriate detecting means is used to determine when packaging material C has been completely removed from web roll R. Then, second holder hydraulic cylinder 39 activates to move second cutting blade 42 to the active position. Guide plate hydraulic cylinder 43 activates so that first guide plate 47 is raised and web W drawn out from web roll R is grasped, bringing web W to a position facing second cutting blade 42. From there, moving body 21 moves leftward from the left end (standby position).

Figure 9:
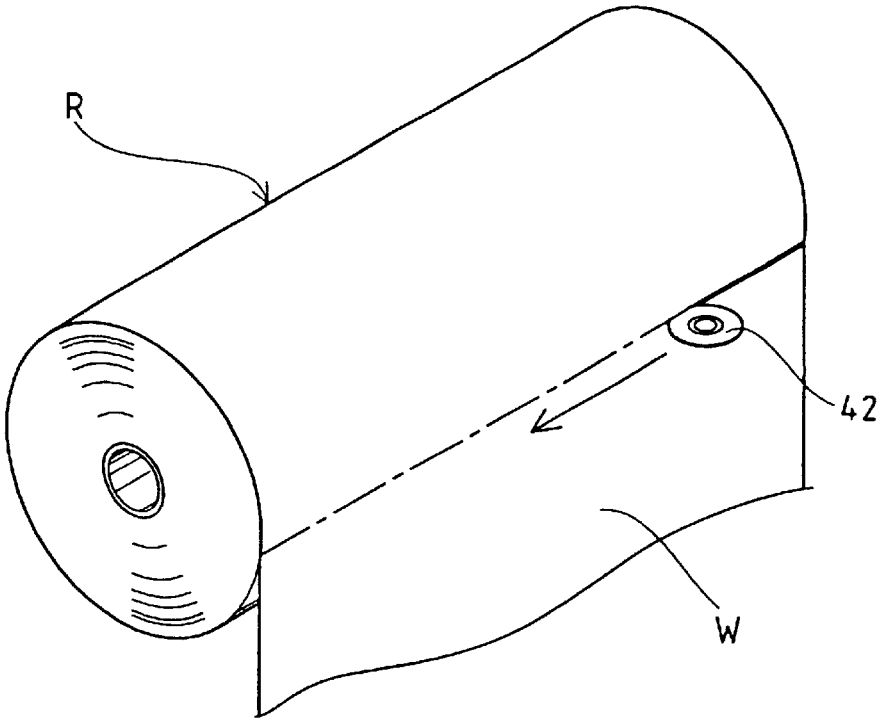
FIG. 9 is a drawing showing the second cutting blade cutting the web laterally.

Referring to FIG. 9, the movement of moving body 21 results in web W being laterally cut and separated from the main roll by second cutting blade 42. The position detection sensor 26 (see FIG. 1) to the right detects dog 27, stops moving body 21 when second cutting blade 42 completes the cut of web W.

Figure 10:
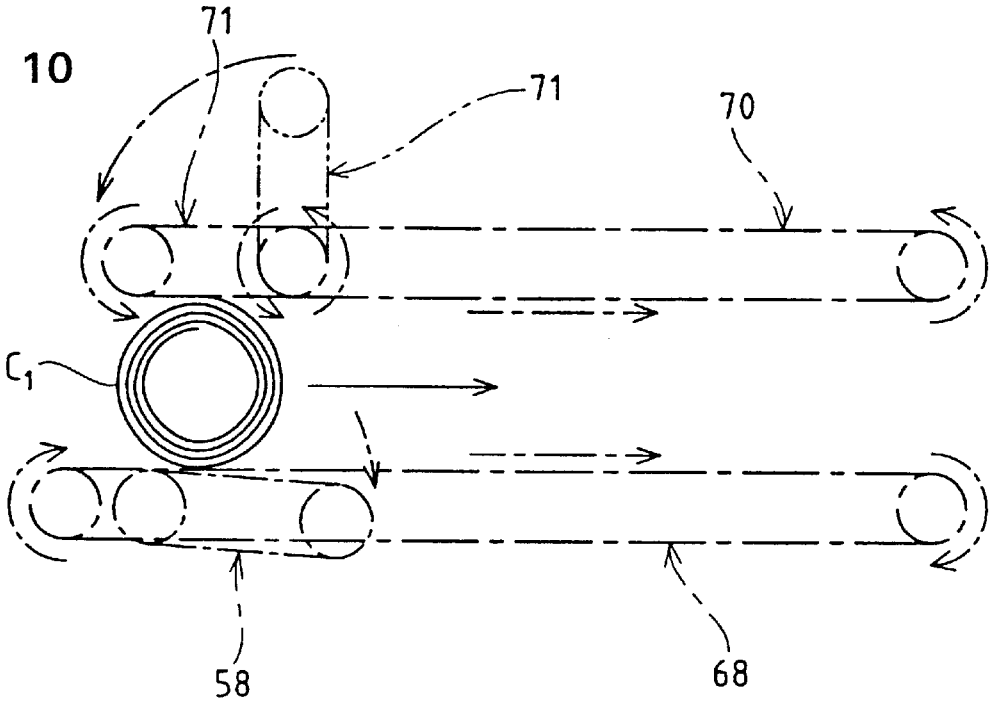
FIG. 10 is a drawing showing the rolled-up packaging material being transported by a feed conveyor and a lower transport belt conveyor.

An appropriate detecting means detects when the cut end of web W cut by second cutting blade 42 is rolled up. Roll-up hydraulic cylinder 67 and feed hydraulic cylinder 77 then activate. Second roll-up conveyor 58 moves from its active position to its recessed position. Feed conveyor 71 moves from its recessed position to its active position, as shown in FIG. 10. Transport motor 69 activates, moving lower transport belt conveyor 68, upper transport conveyor 70, and feed conveyor 71 in prescribed directions. As a result, rolled-up packaging material $C_1$, rolled up by roll-up conveyors 57 and 58, is transported reliably rearward, supported from above and below by lower transport belt conveyor 68 and feed conveyor 71. Rolled-up packaging material $C_1$ is then transferred from feed conveyor 71 to upper transport belt conveyor 70. Packaging material $C_1$ is reliably transported rearward supported from above and below by upper and lower transport belt conveyors 68 and 70. When rolled-up packaging material $C_1$ moves away from feed conveyor 71, roll-up hydraulic cylinder 67 operates in reverse to being second roll-up conveyor 58 from its recessed position to its active position. Feed conveyor 71 is brought from its active position to its recessed position by feed hydraulic cylinder 77(see FIG. 11).

Figure 11:
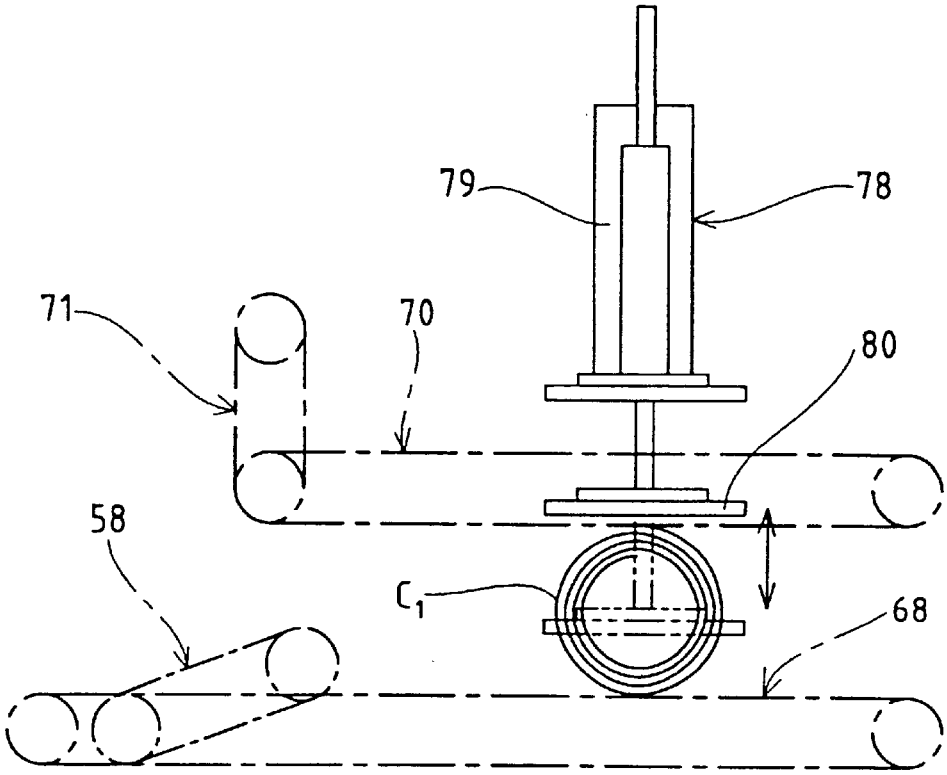
FIG. 11 is a drawing showing how the rolled-up packaging material is flattened by a press.

An appropriate detecting means is used to detect when rolled-up packaging material $C_1$ being transported rearward by upper and lower transport belt conveyors 68 and 70 reaches a position under press 78, as shown in FIG. 11. Upper and lower transport belt conveyors 68 and 70 then stop. Press hydraulic cylinder 79 of press 78 then activates to perform a reciprocating motion a prescribed number of times. As a result, press plate 80 flattens rolled-up packaging material $C_1$ mounted on lower transport belt conveyor 68.

Figure 12:
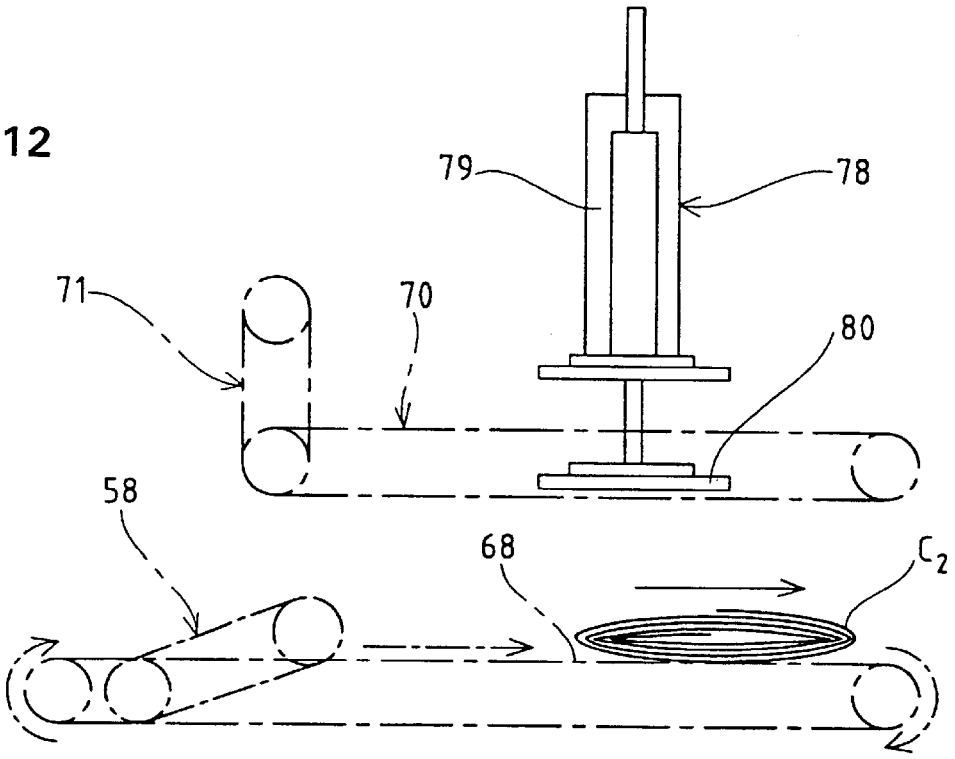
FIG. 12 is a drawing showing the flattened packaging material being transported by the lower transport belt conveyor.

Referring to FIG. 12, when press 78 completes the flattening operation lower transport belt conveyor 68 reactivates to transport flattened packaging material $C_2$ further to the back by belt conveyor 68. Flattened packaging material $C_2$ then passes on from lower transport belt conveyor 68 to exit belt conveyor 81. Flattened packaging material is finally sent out of main unit 17 through conveyor 81.

In this embodiment of the present invention, packaging material removal device M, allowing for the cutting, rolling, and disposing of packaging material C, accomplishes its labor-saving goal. Furthermore, since the rolled-up packaging material is flattened, the resulting flattened packaging material $C_2$ takes up minimum space.

The present invention is not restricted to the embodiment described above, and other configurations can be implemented. For example, instead of a screw and nut combination, the displacement mechanism for the moving body in the cutting device can be a rack and pinion combination or a chain and sprocket combination. Also, an electric motor or the like can be used to drive the first cutting blade instead of an air motor.

In the embodiment described above, the first feed roller and the second feed roller are driven by the same motor. However, it is also possible to have each roller driven by a separate motor. In that case, when the packaging material fed via the rotation of the first feed roller is interposed between the pair of second feed rollers, the first feed roller is stopped and the second feed roller is rotated. This allows a prescribed tension to be applied to the web at the second cutting blade, allowing the second cutting blade to cut reliably. Even if the first roller and the second roller are driven by the same motor, clutches and the like can be used in the drive transfer system so that a similar effect can be provided by engaging and disengaging the clutches when driving the rollers.

In the embodiment described above, the separating member is inserted between webs disposed inward from the packaging material due to the difficulty of reliably inserting the separating member between the packaging material and the web positioned immediately inward from the material. However, inserting the separating member between the packaging material and the web is possible by increasing the manner in which the packaging material is applied or by using more precise positioning for the cutting device. Also, if the first cutting blade can cut just the packaging material, the second cutting blade can be eliminated since the web is not drawn out from the web roll when rolling up the packaging material.

The hydraulic cylinders described above can be oil-based, air-based, or the like, and it is also possible to use combinations of motors, linking mechanisms, and the like in place of hydraulic cylinders. Furthermore, optoelectronic sensors and the like disposed in the feed or transport paths are preferable for detecting positions and the completion of the rolling up of the packaging material.

As described above, with the packaging material removal device for web rolls according to the present invention, packaging material covering the outer perimeter surface of web rolls can be removed automatically. This provides automation and saves labor. Also, the removed packaging material is automatically rolled up and ejected. This reduces the time required for operations and saves labor. Since the rolled-up packaging material is flattened with a press, the packaging material to be disposed does not take up excessive space.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for removing packing material from a web comprising:

a knife;

means for displacing said rotatable knife along an axis of said web to slit said packing material;

a feed device effective for rotating said web;

an arcuate rollup conveyor;

at least one guide member for guiding a slit edge of said packing material to said arcuate rollup conveyor;

a second rollup conveyor;

said second rollup conveyor having first and second positions;

in its first position, said second rollup conveyor being positioned to be contacted by said slit edge;

said second rollup conveyor having a working surface movable in a direction toward said arcuate rollup conveyor, whereby said packing material is rolled up into a tube;

a transport conveyor leading from a lower level of said arcuate rollup conveyor;

said second position placing said rollup conveyor into a position in which its working surface is below a working surface of said transport conveyor, whereby said tube rests on said transport conveyor; and said transport conveyor being movable for displacing said tube out of said arcuate rollup conveyor in a direction at right angles to an axis of said tube toward a disposal location.

2. A device according to claim 1, wherein said disposal location includes a pressing device effective for flattening said tube for compactness of disposal thereof.

3. A device according to claim 1, further comprising:

a second transport conveyor generally parallel to said transport conveyor;

said second transport conveyor being spaced above said transport conveyor a distance smaller than a diameter of said tube; and said second transport conveyor being movable in said direction so that both upper and lower surfaces of said tube are urged toward said disposal location.

4. A device according to claim 3 wherein:

said second transport conveyor includes a feed conveyor;

said feed conveyor being movable between first and second positions;

said first position being parallel to a path of said slit edge;

said first position opening a path for said slit edge to enter said arcuate rollup device;

said second position closing said path after said packing material is rolled into said tube; and said second position forming an extension of said second transport conveyor, effective for guiding said tube toward said disposal location.

* * * * *